United States Patent [19]

Buran et al.

[11] 4,212,602

[45] Jul. 15, 1980

[54] WEAR-RESISTANT COATING FOR SEALING STRIPS IN ROTARY ENGINES

[75] Inventors: Ulrich Buran; Horst Beyer, both of Burscheid, Fed. Rep. of Germany

[73] Assignee: Goetzewerke Friedrich Goetze AG, Burscheid, Fed. Rep. of Germany

[21] Appl. No.: 603,249

[22] Filed: Aug. 8, 1975

[30] Foreign Application Priority Data

Aug. 14, 1974 [DE] Fed. Rep. of Germany ..... 2438923

[51] Int. Cl.[2] ..... F01C 19/04; B23K 9/04

[52] U.S. Cl. ..... 418/178; 418/179; 123/193 C; 219/76.16

[58] Field of Search ..... 418/178, 179; 417/DIG. 1; 308/DIG. 8; 123/193 C; 92/169; 427/423, 375, 191, 224, 225, 226; 219/76.16, 121 P

[56] References Cited

U.S. PATENT DOCUMENTS

| | | | |
|---|---|---|---|
| 3,050,409 | 8/1962 | Bayer | 427/191 X |
| 3,071,678 | 1/1963 | Neeley et al. | 219/76.16 |
| 3,102,044 | 8/1963 | Joseph | 117/22 |
| 3,246,114 | 4/1966 | Matvay | 427/423 X |
| 3,310,423 | 3/1967 | Ingham, Jr. | 427/223 X |
| 3,333,579 | 8/1967 | Shockley | 123/193 |
| 3,674,544 | 7/1972 | Grosseau | 427/423 X |
| 3,693,608 | 9/1972 | Neishi | 418/178 X |
| 3,808,955 | 5/1974 | Hamada et al. | 92/169 |
| 3,829,260 | 8/1974 | Shimoda | 418/178 |
| 3,877,854 | 4/1975 | Sesame | 418/178 |
| 3,902,830 | 9/1975 | Maeda | 418/178 X |
| 3,910,734 | 10/1975 | Telang | 418/178 |
| 3,918,137 | 11/1975 | Telang et al. | 418/178 X |

FOREIGN PATENT DOCUMENTS

| | | | |
|---|---|---|---|
| 1223613 | 8/1966 | Fed. Rep. of Germany | 418/178 |

OTHER PUBLICATIONS

Research-Development Powders for Flame Spraying, Metco Bulletin 10F, 1963.

The Metco Flame Spraying Processes, Metco Bulletin 136B, 1960, pp. 11 & 12.

*Primary Examiner*—Leonard E. Smith

*Attorney, Agent, or Firm*—Spencer & Kaye

[57] ABSTRACT

A wear-resistant coating is provided for a sealing strip used in a rotary engine having a trochoidal chamber made of a supereutectic aluminum-silicon alloy. The coating consists essentially of chromium or a chromium alloy applied by plasma deposition welding.

27 Claims, 2 Drawing Figures

WEAR-RESISTANT COATING FOR SEALING STRIPS IN ROTARY ENGINES

BACKGROUND OF THE INVENTION

The present invention relates to a wear-resistant coating on sealing strips of rotary engines having a trochoidal chamber and more particularly to a wear-resistant coating for a trochoidal chamber made of a supereutectic aluminum-silicon alloy, to the sealing strips containing this coating, and to the method of producing such a sealing strip.

For the proper operation of rotary engines, it is important to provide a particularly good dissipation of the combustion heat as well as movement without wear of the partners which seal the combustion chambers. The friction partners which seal the combustion chamber are the chamber walls of the rotary engine which have a trochoidal shape and sealing strips disposed at the corners of the piston. Materials with good heat conductivity are best suited to dissipate the combustion heat and have been used for the trochoidal chamber walls. In the past, light metal alloys preferably have been used for the trochoidal chamber walls. These materials, however, generally have such low stability and wear-resistance that the trochoidal walls must be provided with reinforcing coatings. Thus, coating sold under the name ELNISIL have been found acceptable on light metal trochoidal chamber walls. Those coatings consist of electrodeposited nickel layers with inserted SiC particles and are produced by NSU-Motorenwerke/Germany. Their friction partners, the sealing strips, may be made of a hard metal or ceramic sinter materials.

Recently, the development of supereutectic aluminum-silicon alloys resulted in a light metal which, due to its good heat conductivity and its simultaneously improved hardness and wear-resistance, can be used for producing trochoidal chambers so that their contact surfaces no longer need be protected by a special coating. For instance, such supereutectic aluminum-silicon alloys are described in U.S. Pat. No. 3,333,579 and consist of 16 to 18% silicon, 4 to 5% copper and aluminum in balance.

Conventional sealing strips, mainly those made of hard metals and ceramic sinter materials, are too aggressive compared to the trochoidal chambers made of supereutectic aluminum-silicon alloys and these sealing strips cut into the trochoidal contact surfaces and destroy them.

Piston engines with cylinders made of supereutectic aluminum-silicon alloys are known to produce good results when the sealing elements, that is, the piston rings, are provided with an electrolytically deposited hard chromium layer. Tests on rotary engines with chromium-plated sealing strips, however, were unsuccessful. The reason for this is mainly that the electrolytically deposited layers are too thin for the amount of wear involved, while thicker electrolytically deposited layers could easily clip off or break as a result of developing internal stresses. In addition, the lubrication conditions in a rotary engine are less favorable than in a piston engine so that the sealing strips with electrolytically deposited hard chromium layers easily lead to burn traces and binding pistons. Further, the coatings on sealing strips used in rotary engines are subjected to centrifugal forces so that better adhesion is required for such coatings than with coatings for piston rings.

SUMMARY OF THE INVENTION

It is therefore a primary object of the present invention to provide a sealing strip with wear-resistant contact surfaces which simultaneously forms a nonaggressive friction partner for the trochoidal chamber walls made of supereutectic aluminum-silicon alloys.

It is a further object of the present invention to provide a method for forming such a sealing strip.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects, and in accordance with its purpose, the present invention, as embodied and broadly described, provides a wear-resistant coating for the contact surface of the sealing strip, which coating consists essentially of a layer of chromium and/or a chromium alloy which is applied to the sealing strip by means of a plasma deposition welding process. Surprisingly, the sealing strips which have been coated according to the present invention, exhibit extraordinary compatibility during motor tests with trochoidal chambers made of a supereutectic aluminum-silicon alloy so that no binding traces develop.

It is to be understood that both the foregoing general description and the following detailed description are exemplary, but are not restrictive of the invention.

DETAILED DESCRIPTION OF THE INVENTION

Figure 1:
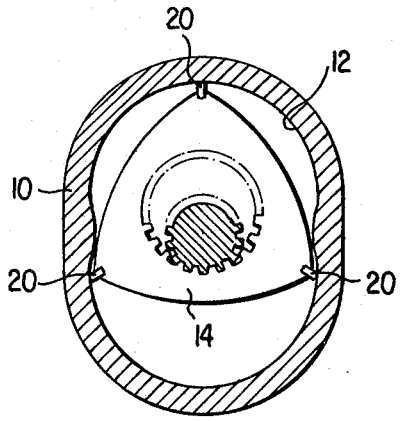
FIG. 1 is a cross-sectional view of a sealing strip made in accordance with the present invention and mounted in a rotor housing having a trochoidal chamber wall.
Figure 2:
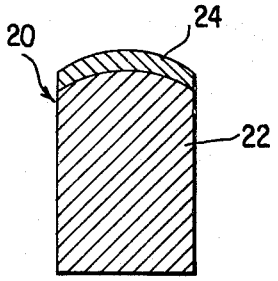
FIG. 2 is a cross-sectional view of the sealing strip of FIG. 1.

Referring to FIG. 1, there is shown sealing strips 20 attached to rotor 14 which is mounted in a rotor housing 10 having a trochoidal chamber wall 12.

The basic material 22 of the sealing strip 20 on which the coating 24 is applied is generally cast iron. Additionally, one can use steel or non-ferrous materials with a good coefficient of elasticity.

In accordance with the present invention, the chromium or chromium alloy coating 24 of the sealing strip 20 is formed by plasma desposition welding of a powder onto the sealing strip. When the coating is a chromium alloy, the chromium can be alloyed with at least one of the elements iron, manganese, nickel, cobalt, molybdenum, tantalum, niobium, tungsten, zirconium and/or titanium. The sum of all these existing additional elements should not be below about 3 percent by weight and not above about 80 percent by weight. The above-mentioned elements can be in the powder as an alloy directly with the chromium or can be merely mixed therein, such as in elemental form with chromium. When the additional elements are merely mixed with chromium in the powder, an alloy of the elements with chromium generally is formed during the plasma deposition welding. As used herein, the term "chromium alloy powder" refers to a powder which contains chromium alloyed with one of these additional elements or to a powder containing chromium mixed with one of these additional elements.

In a preferred embodiment of the invention, small quantities of carbon and/or silicon are added to and mixed in the powder. The addition of carbon and/or silicon has been found to be useful mainly if the basic material for the sealing strip is something other than cast iron. The total added quantities of carbon and/or silicon preferably are between about 0.5 and about 7.5 percent by weight of the powder.

Further, the anti-friction or sliding properties of the thus coated sealing strip can be improved by the addition of elemental boron to the powder. The amount of elemental boron preferably should be between about 0.5 and about 22 percent by weight of the powder.

Additional improvements are obtained if the chromium or chromium alloy powders, respectively, are charged with at least one of the gases of hydrogen, nitrogen or oxygen before the powders are welded on. This is done, for example, by spraying the completely mixed weld-depositing powders in molten state into a chamber containing the corresponding gas before the welding deposition of the powders. By varying the ejection parameters and gas pressures, it is possible to set a defined gas content in the powder mixture. A content of 0.01 to 0.5 percent by weight hydrogen, 0.005 to 0.5 percent by weight nitrogen and 0.5 to 2.5 percent by weight oxygen has been found to be particularly suitable.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

In one embodiment of the invention, 83 parts by weight of elemental chromium powder, 12 parts by weight of elemental molybdenum powder, and 5 parts by weight of elemental iron powder are intimately mixed together. This powder mixture is charged with about 1.7 percent by weight of oxygen by spraying the powder in its molden state into a chamber having oxygen atmosphere. The powder is then applied to the contact surface of a sealing strip of cast iron in a thickness of about 1 mm. In the following step this powder is welded together with the aid of a plasma welding torch and bonded to the surface.

EXAMPLE 2

In another embodiment of the invention 48 parts by weight of elemental chromium powder, 12 parts by weight of elemental molybdenum powder, 5 parts by weight of elemental iron powder, and 35 parts by weight of elemental tungsten powder are intimately mixed together. This powder mixture is charged with about 1.7 percent by weight of oxygen by spraying the powder in its molten state into a chamber having oxygen atmosphere. This powder is then applied to the contact surfaces of a sealing strip of cast iron in a thickness of about 1 mm. In the following step this powder is welded together with the aid of a plasma welding torch and bonded to the surface.

EXAMPLE 3

In another embodiment of the invention 60 parts by weight of elemental chromium, 5 parts by weight of elemental nickel, 5 parts by weight of elemental cobalt, 15 parts by weight of elemental molybdenum and 5 parts by weight of elemental tungsten are intimately mixed with 6 parts by weight of elemental boron powder and 4 parts by weight of graphitic carbon. This powder is then applied to the contact surface of a sealing strip made from steel in a thickness of about 1 mm. In the following step this powder is welded together with the aid of a plasma welding torch and bonded to the surface.

It will be understood that the above description of the present invention is susceptible to various modifications, changes and adaptations, and the same are intended to be comprehended within the meaning and range of equivalents of the appended claims.

What is claimed is:

1. In a method of providing a wear-resistant coating on a sealing strip of a rotary engine having a trochoidal chamber made of a supereutectic aluminum-silicon alloy comprising applying a coating consisting essentially of chromium or a chromium alloy containing at least about 20% by weight chromium, and wherein said alloy contains between about 3% and about 80% of at least one of the alloying elements iron, manganese, nickel, cobalt, molybdenum, tantalum, niobium, tungsten, zirconium, or titanium, the improvement wherein said coating is applied as a powder which contains at least one of the elements hydrogen, nitrogen and oxygen, and when hydrogen is present in said powder, it is present in an amount of 0.1% to 0.5% by weight;

when nitrogen is present in said powder, it is present in an amount of 0.005% to 0.5% by weight; and when oxygen is present in said powder, it is present in a level of 0.5% to 2.5% by weight.

2. The method as defined in claim 2 wherein said alloy contains about 3% to about 52% by weight of said alloying elements.

3. The method as defined in claim 2 wherein at least one of the elements hydrogen, nitrogen and oxygen is charged into said powder before said powder is applied to said sealing strip by spraying said powder in a molten state in a gaseous atmosphere containing at least one of the elements hydrogen, nitrogen and oxygen.

4. In a sealing strip for a rotary engine having a trochoidal chamber made of a supereutectic aluminum-silicon alloy wherein said strip contains a wear-resistant coating which is applied by plasma deposition welding and which consists essentially of chromium or a chromium alloy containing at least about 20% by weight chromium, and wherein said alloy contains between about 3% and about 80% of at least one of the alloying elements iron, manganese, nickel, cobalt, molybdenum, tantalum, niobium, tungsten, zirconium, or titanium, the improvement wherein said coating is applied as a powder which is charged with at least one of the elements hydrogen, nitrogen, and oxygen, and when hydrogen is present in said powder, it is present in an amount of 0.01% to 0.5% by weight;

when nitrogen is present in said powder, it is present in an amount of 0.005% to 0.5% by weight; and when oxygen is present in said powder, it is present in an amount of 0.5% to 2.5% by weight.

5. The sealing strip as defined in claim 4, wherein said alloy contains about 3% to about 52% by weight of said alloying elements.

6. In a method for providing a wear-resistant coating on a sealing strip of a rotary engine having a trochoidal chamber made of a supereutectic aluminum-silicon alloy comprising applying a coating consisting essentially of chromium or a chromium alloy containing at least about 20% by weight chromium, and wherein said alloy contains between about 3% and about 80% of at least one of the alloying elements iron, manganese, nickel, cobalt, molybdenum, tantalum, niobium, tungsten, zirconium, or titanium, the improvement wherein said coating is applied as a powder which contains about 0.5% to about 22% by weight boron.

7. The method as defined in claim 6 wherein said alloy contains about 3% to about 52% by weight of said alloying elements.

8. The method as defined in claim 6 wherein said powder additionally contains at least one of the elements hydrogen, nitrogen, and oxygen, and when hydrogen is present in said powder, it is present in an amount of 0.1% to 0.5% by weight;

when nitrogen is present in said powder, it is present in an amount of 0.005% to 0.5% by weight; and when oxygen is present in said powder, it is present in an amount of 0.5% to 2.5% by weight.

9. The method as defined in claim 8 wherein said alloy contains about 3% to about 52% by weight of said alloying elements.

10. In a sealing strip for a rotary engine having a trochoidal chamber made of a supereutectic aluminum-silicon alloy wherein said strip contains a wear-resistant coating which is applied by plasma deposition welding and which consists essentially of chromium or a chromium alloy containing at least about 20% by weight chromium, and wherein said alloy contains between about 3% and about 80% of at least one of the alloying elements iron, manganese, nickel, cobalt, molybdenum, tantalum, niobium, tungsten, zirconium, or titanium, the improvement wherein said coating is applied as a powder which contains about 0.5% to about 22% by weight boron.

11. The sealing strip as defined in claim 10 wherein said alloy contains about 3% to about 52% by weight of said alloying elements.

12. The sealing strip as defined in claim 10 wherein said powder is charged with at least one of the elements hydrogen, nitrogen, and oxygen, and when hydrogen is present in said powder, it is present in an amount of 0.01% to 0.5% by weight;

when nitrogen is present in said powder, it is present in an amount of 0.005% to 0.5% by weight; and when oxygen is present in said powder, it is present in an amount of 0.5% to 2.5% by weight.

13. The sealing strip as defined in claim 12 wherein said alloy contains about 3% to about 52% of said alloying elements.

14. In a method for providing a wear-resistant coating on a sealing strip of a rotary engine having a trochoidal chamber made of a supereutectic aluminum-silicon alloy comprising applying a coating consisting essentially of chromium or a chromium alloy containing at least about 20% by weight chromium, and wherein said alloy contains between about 3% and about 80% of at least one of the alloying elements iron, manganese, nickel, cobalt, molybdenum, tantalum, niobium, tungsten, zirconium, or titanium, the improvement wherein said coating is applied as a powder which contains about 0.5% to about 7.5% by weight of at least one of the elements carbon and silicon.

15. The method as defined in claim 14 wherein said alloy contains about 3% to about 52% by weight of said alloying elements.

16. The method as defined in claim 14 wherein said powder additionally contains about 0.5% to about 22% by weight boron.

17. The method as defined in claim 16 wherein said alloy contains about 3% to about 52% by weight of said alloying elements.

18. The method as defined in claim 14 wherein said powder additionally contains at least one of the elements hydrogen, nitrogen, and oxygen, and when hydrogen is present in said powder, it is present in an amount of 0.1% to 0.5% by weight;

when nitrogen is present in said powder, it is present in an amount of 0.005% to 0.5% by weight; and when oxygen is present in said powder, it is present in an amount of 0.5% to 2.5% by weight.

19. The method as defined in claim 18 wherein the coating is applied as a powder which contains from about 0.5% to about 22% by weight boron.

20. The method as defined in claim 18 wherein said alloy contains about 3% to about 52% by weight of said alloying elements.

21. In a sealing strip for a rotary engine having a trochoidal chamber made of a supereutectic aluminum-silicon alloy wherein said strip contains a wear-resistant coating which is applied by plasma deposition welding and which consists essentially of chromium or a chromium alloy containing at least about 20% by weight chromium, and wherein said alloy contains between about 3% and about 80% of at least one of the alloying elements iron, manganese, nickel, cobalt, molybdenum, tantalum, niobium, tungsten, zirconium, or titanium, the improvement wherein said coating is applied as a powder which contains about 0.5% to about 7.5% by weight of at least one of the elements carbon and silicon.

22. The sealing strip as defined in claim 21 wherein said alloy contains about 3% to about 52% by weight of said alloying elements.

23. The sealing strip as defined in claim 21 wherein said powder additionally contains about 0.5% to about 22% by weight boron.

24. The sealing strip as defined in claim 23 wherein said alloy contains about 3% to about 52% by weight of said alloying elements.

25. The sealing strip as defined in claim 20 wherein said powder is charged with at least one of the elements hydrogen, nitrogen, and oxygen, and when hydrogen is present in said powder, it is present in an amount of 0.01% to 0.5% by weight;

when nitrogen is present in said powder, it is present in an amount of 0.005% to 0.5% by weight; and when oxygen is present in said powder, it is present in an amount of 0.5% to 2.5% by weight.

26. The sealing strip as defined in claim 25 wherein the coating is applied as a powder which contains from about 0.5% to about 22% by weight boron.

27. The sealing strip as defined in claim 25 wherein said alloy contains about 3% to about 52% by weight of said elements.

* * * * *